United States Patent [19]

Willenbacher

[11] Patent Number: 4,526,117

[45] Date of Patent: Jul. 2, 1985

[54] SEWING MACHINE MATERIAL GUIDING DEVICE

[75] Inventor: Erich Willenbacher, Kaiserslautern, Fed. Rep. of Germany

[73] Assignee: Pfaff Industriemaschinen GmbH, Fed. Rep. of Germany

[21] Appl. No.: 594,103

[22] Filed: Mar. 28, 1984

[30] Foreign Application Priority Data

Apr. 22, 1983 [DE] Fed. Rep. of Germany ..... 3314717

[51] Int. Cl.[3] ..... D05B 27/08; D05B 35/10

[52] U.S. Cl. ..... 112/308; 112/153

[58] Field of Search ..... 112/308, 309, 153

[56] References Cited

U.S. PATENT DOCUMENTS

| | | | |
|---|---|---|---|
| 4,100,864 | 7/1978 | Babson et al. | 112/308 X |
| 4,135,460 | 1/1979 | Biotteau | 112/308 X |
| 4,226,197 | 10/1980 | Pollmeier et al. | 112/308 X |
| 4,296,700 | 10/1981 | Jehle et al. | 112/308 X |
| 4,312,286 | 1/1982 | Biotteau | 112/308 |
| 4,423,690 | 1/1984 | Willenbacher et al. | 112/308 |

*Primary Examiner*—Hampton H. Hunter

*Attorney, Agent, or Firm*—McGlew and Tuttle

[57] ABSTRACT

A sewing machine with a guiding device for the automatic sewing of a curved seam parallel to the edge. Provided are an edge guide ruler and a device with a first setting means to raise and lower a pressure pad disposed at a lateral distance from the needle and exerting a braking force on the workpiece and effecting, in interaction with the material feeder, the workpiece alignment motion. For more precise control the pressure pad is movable transverse to the workpiece direction by a second setting means to vary its lateral distance from the needle, and the setting means is controllable as a function of predeterminable part sections of the entire seam. This makes it possible to cause the pressure pad to contact the workpiece in the respective center of rotation of outside curves.

11 Claims, 3 Drawing Figures

SEWING MACHINE MATERIAL GUIDING DEVICE

FIELD AND BACKGROUND OF THE INVENTION

This invention relates in general to sewing machines and in particular to a new and useful material guiding device which comprises a pressure pad holder which is pivotally supported adjacent the sewing needle and includes a pressure pad which is movable in the holder and a holder which is selectively movable to shift the pressure pad.

Known from German Pat. No. 25 22 422 is a sewing machine for the automatic sewing of such seams, there being provided on one side of the needle a guide ruler and on the opposite side of the needle a pressure pad. The drive mechanism for the pressure pad is a pneumatic cylinder, driven via a solenoid valve by a device scanning the edge of the material in outwardly curved material areas deviating from a straight line in order to lower the pressure pad onto the material to produce a curved seam parallel to the edge at a lateral distance from the needle and to push the pressure pad against its bearing surface to generate a braking force. Due to the continued operation of the material feeder the material is turned about the pressure pad as axis of rotation in accordance with the shape of the edge. The pressure must be great enough so that the tightest curve can still be sewn accurately in a workpiece to produce a seam parallel to the edge. But the consequence thereof is that all curves having a greater radius cannot be controlled parallel to the edge, or only when materials of great natural stiffness are involved. The spacing of the guide ruler from the needle must correspond to the desired spacing of the seam from the material edge, which follows from the tightest curve of the material contour. By the same token, the spacing of the pressure pad impact point from the needle must be in harmony with the tightest curve of the material.

Since in all larger curves the pressure pad impact point is outside of the center of the curve radius, the pressure exerted by the pressure pad can be overcome by the reactive force acting upon the material when the latter's edge is pushed, during the turning motion, against the guide ruler only when naturally very stiff materials are involved so that the material slips under the pressure pad transverse to the feeding direction away from the guide ruler. This means that curves with larger radii of curvature can be controlled parallel to the edge only when naturally stiff materials are being sewn.

To improve the control it has already been suggested (German OS No. 27 16 914) to control the force acting upon the pressure pad as a function of the size of the radius of curvature so as to increase with decreasing radius. But even with this type of contour control it is not possible to obtain a contour-correct seam parallel to the edge when soft materials are involved because the natural stiffness of the material is insufficient to transform the force which acts as torque when the pressure pad is lowered and the material feeder continues operating and which pushes the edge of the material against the guide ruler during the turning motion partly into a force to move it transversely under the lowered pressure pad away from the guide ruler so as to react upon the material. Due to its little natural stiffness the edge area of the material pushed against the guide ruler during the turning motion escapes upwardly at the guide ruler and is placed in a vertical position, often even rolled up.

In the area of curves having a radius larger than the smallest radius of curvature this results, in a stretched position, in a seam spaced further away from the edge than in straight edge areas or at the tightest curve of the material. When binding, the rolled up edge areas are enveloped by the binding tape and sewn in. This can falsify the outer contour of the material considerably in part.

To avoid the disadvantages mentioned, especially when processing materials of little natural stiffness, it has been proposed in German OS No. 30 48 198 to drive the pressure pad intermittently as a function of the angular position of the sewing machine main shaft so that the pressure phase of the pressure pad essentially coincides with the feeding phase of the material feeder of the sewing machine.

Driving the pressure pad intermittently achieves that braking force pulses are caused to act upon the material in rapid succession while the material is turned in smaller angular amounts by the material feeder, whereas no pressure is exerted in the intervals between each two pressure phases. In the process, the material can escape away from the guide ruler transverse to the material feeding direction to the same extent that its lateral edge is pushed against the guide ruler, without having to overcome a pressure pad resistance. While in most cases, the correction of the material position achieved by this measure suffices to obtain a satisfactory result, both the oscillatory frequency and the contact pressure imparted to the pressure pad would have to be adapted to the respective thickness of the material to be processed when material of greatly varying thickness in running sequence is being processed, if deviations from the desired result are to be avoided. This, however, is not feasible in practice because sewing tests have to be conducted on some workpieces to arrive at a new setting, causing considerable time losses.

SUMMARY OF THE INVENTION

The invention provides, in material with an outer contour of different radii of curvature, a more precise control of the aligning motions, independent of the thickness and nature of the material, and an arrangement of the pressure pad so that it can be placed in the respective centers of rotation of the radii of curvature of the material.

In accordance with the invention, there is provided a sewing machine which has a reciprocating needle, material feeder means for feeding material into association with the needle for the automatic sewing of a curved seam parallel to the edge of the material. The machine also includes a guide ruler for the material edge and a pressure pad which is engageable with the workpiece at a distance from the needle. In accordance with the invention, there is provided a device for setting the pressure pad at selected engagement levels within a mounting holder and in addition, the mounting holder itself is mounted for shifting movement so that the pressure pad may be engaged with the material at selected distances from the needle so as to effect a material aligning motion in interaction with the needle feeding means. The pressure pad itself is advantageously positioned in its holder by pressure operated control of a piston secured to the pressure pad. The setting of the holder is effected by means of a compound fluid pressure piston and cylinder arrangement to pivot the holder about a support member.

The pressure pad is moved, while the beginning of a predetermined part section of the entire seam is being sewn, into a position transverse to the feeding direction by the second setting means. It is placed, after lowering, into its position in the center of rotation of the radius of curvature belonging to the respective part section of the seam, in which position it effects material alignment motion. In other words, the point where a braking force is exerted on the workpiece is also the fulcrum for an aligning motion. Consequently, moving the material transversely to correct its position relative to the edge guide ruler is not necessary. Driving the pressure pad intermittently can be eliminated, and material thickness and nature have no influence on the control of the material.

Accordingly, it is an object of the invention to provide an improved pressure pad holder and mounting arrangement which permits selective movement of the pressure pad into engagement with the material being sewn as it is fed into association with a needle and guided by an edge member.

A further object of the invention is to provide a sewing machine material control device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 2:
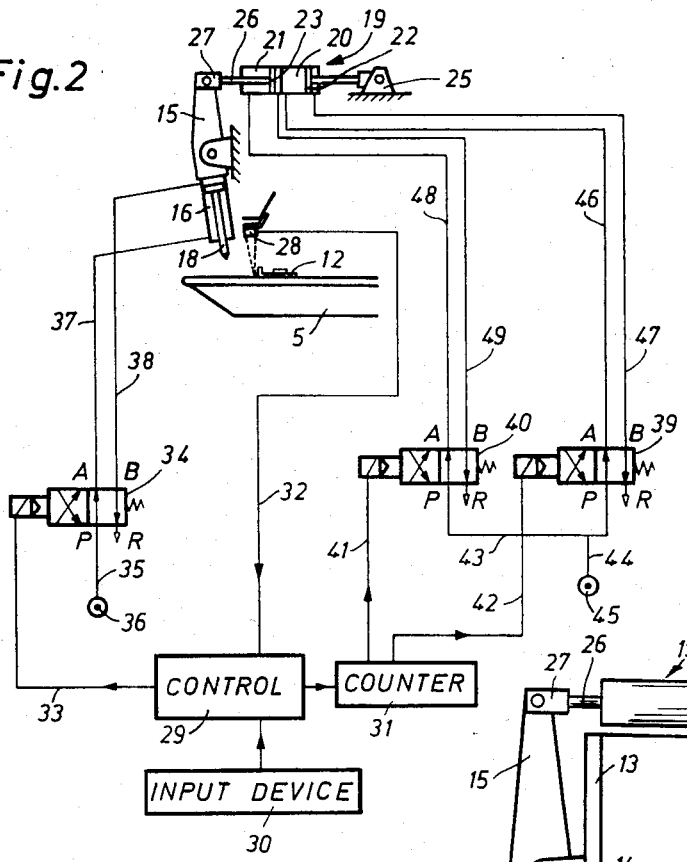
FIG. 2 is schematic of a circuit diagram for the control of the pressure pad.

Referring to the drawings in particular the invention embodied therein comprises a sewing machine generally designated 2 which has a base 5 having a needle plate 9 over which the material workpiece W to be sewn is moved while being aligned by an edge member or ruler 12. The sewing machine includes a known material feeder plate 9 and a reciprocating needle 4 which cooperates with a shuttle 6 and the turning of the workpiece is effected by the feeding mechanism in cooperation with a pressure pad 18 which is engaged with the material at selected locations.

In accordance with the invention, the pressure pad 18 is mounted in a pressure holder or cylinder 16 for selective up and down positioning in the cylinder. In addition, the cylinder itself is carried by a holder 15 which is pivotable about bolt 17 of a fork member or bracket 14 secured to the front of the sewing machine 1. Control means 19 for shifting the holder and hence the position at which the pressure pad 18 engages the workpiece and which permits the selected positioning of the level of the pressure pad 18 are actuated in order to position the pressure pad to effect the desired movement of the workpiece W during the sewing operation and the feeding of the workpiece so as to effect any desired curve formation in the sewing of a seam generally designated N.

Figure 3:
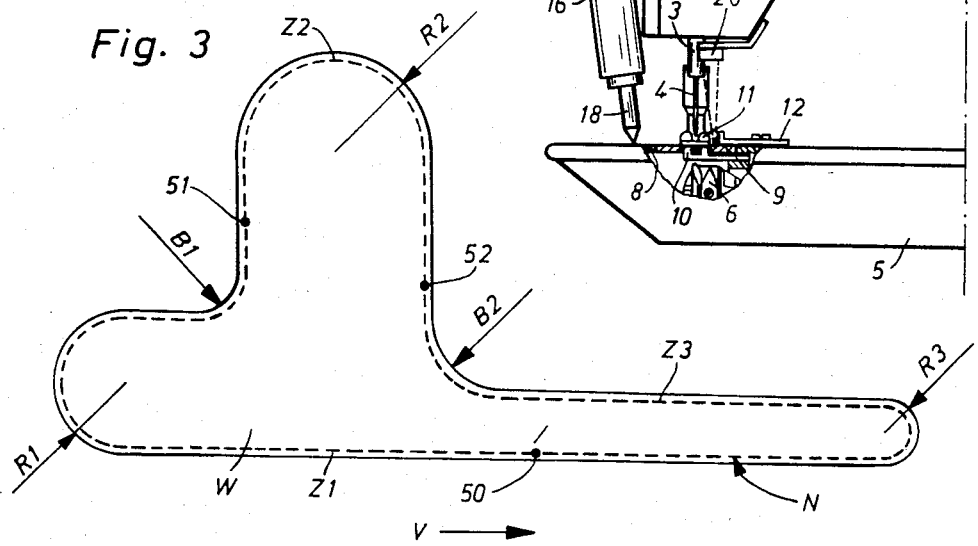
FIG. 3 is a top view of a workpiece example with different radii of curvature.

Mounted in the head 1 of the sewing machine 2; which may be equipped with a known tape binder (not shown) to bind the outer edge of a workpiece W, shown in FIG. 3 as a material sample with a binding tape, is the needle bar 3 which is movable upwardly and downwardly and supports at its lower end the thread-bearing needle 4 which interacts with a shuttle 6 disposed in the material support plate 5 to form a seam N, FIG. 3. The shuttle 6 is covered up by the slide 8 and the needle plate 9. The transport of the workpiece W is effected by the known material feeder 10 which performs a rectangular motion and whose toothed webs penetrate slots in the needle plate 9 during the feeding phase to engage the workpiece W. The workpiece W is pressed against the feeder 10 and the needle plate 9 by a press foot 11 fastened to the conventional, spring-loaded pressure bar.

For guidance of the workpiece W there is fastened to the material support plate 5 on one side of the needle an edge ruler 12 which is adjustable transverse to the material feeding direction, arrow V, FIG. 3. Mounted to the head plate 13 of the sewing machine 2 is a fork 14 in which a holder 15 of a double-acting pneumatic cylinder 16 pivots about a bolt 17. A pressure pad 18 is rigidly joined to the working piston of the pneumatic cylinder 16.

Pivoting the pneumatic cylinder 16 and with it the pressure pad 18 about the pivot pin 17 is accomplished by a pneumatic multiple position cylinder 19 which has two separate cylinder chambers 20 and 21, each with a working piston 22 and 23, respectively. The piston rod 24 associated with the working piston 22 is linked to a bearing block 25 on the machine housing while the piston rod 26 associated with the working piston 23 is provided with a forked head 27 and linked to the free end of the holder 15.

Instead of the multiple position cylinder 19 a stepping motor may also be used to move the holder 15 and with it the pressure pad 18.

The control unit of the sewing machine and of the pneumatic cylinders 16 and 19 contains an edge scanning device 28 consisting of a light source and a photodiode, a central control unit 29, an input device 30 connected to the former and a counter 31 likewise connected to the control unit 29.

To control the pneumatic cylinder 16 for lowering and raising the pressure pad 18 the edge scanning device 28 is connected via an electrical line 32 to the control unit 29 and the latter, in turn, to a solenoid valve 34 via an electrical line 33. In neutral position the pump nipple P of the solenoid valve 34, connected by a hose line 35 to a compressed air source 36, is connected to the working nipple A which, in turn, is connected to the lower end of the pneumatic cylinder 16 via a hose line 37. The working nipple B, vented in neutral position via the return line R, is connected to the upper end of the pneumatic cylinder 16 by a hose line 38.

Two solenoid valves 39,40, each connected to the counter 31 connected to the control unit 29 via an electrical line 41, 42, respectively, are provided for the actuation of the multiple position cylinder 19.

In neutral position, the pump nipple P of the solenoid valve 39, connected to a compressed air source 45 via hose lines 43, 44, communicates with the working nipple A which is connected via a hose line 46 shown in FIG. 2, to the left side of the cylinder chamber 20 and the working nipple B is vented in neutral position via the nipple R, communicates with the right side of the cylinder chamber 20 of the multiple position cylinder 19 via a hose line 47. By the same token, the pump nipple P of the solenoid valve 40 is connected in neutral position to the working nipple A and communicates with the compressed air source 45 through the line 43, 44. The working nipple A is connected by a hose line 48 to the (FIG. 2) left side of the cylinder chamber 21, and the working nipple B, vented in neutral position of the solenoid valve 40 via the nipple R, to the right side of the cylinder chamber 21 of the multiple cylinder 19 via a hose line 49.

Provided as control data for the control of the sewing machine and of the pressure pad 18, to be stored in the central control unit 29, are part sections Z1,Z2,Z3 of the entire seam N, fixed by stitch counting. In the example, the part section Z1 contains the outside curve of the workpiece W with the turning radius R1, the part section Z2, the outside curve with the turning radius R2 and the part section Z3, the outside curve with the turning radius R3. The values for the turning radii R1, R2, R3 correspond to the distances of the pressure pad 18 from the needle 4. They are coordinated with the respective part sections Z1, Z2, Z3, entered in the central control unit 29 by means of the input device 30 and stored.

Figure 1:
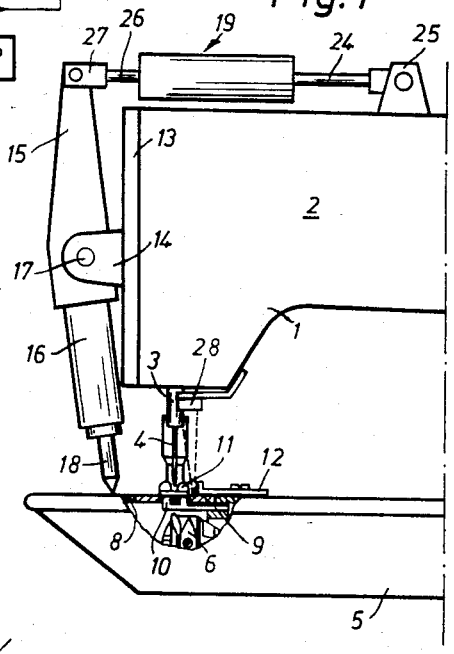
FIG. 1 shows a simplified partial elevational view of a sewing machine with the two setting means for the pressure pad.

The operating mode when sewing a seam N parallel to the edge of a workpiece W is as follows:

Before sewing begins, the spot of the workpiece W where the seam is to start and which is marked by the number 50 is placed under the raised pressure pad 18 and press foot 11 under the raised needle 4 so that the edge abuts the edge ruler 12, whereupon the press foot 11 is lowered and the sewing machine 2 turned on. Through a known pulse transmitter mounted on the main shaft of the sewing machine the counter 31 receives one count pulse per stitch. If in the starting area of the part section Z1 of the entire seam N the photodiode of the edge scanning device 28 remains dark for several stitches on account of the shape of the workpiece W, which is the case when the scanned spot of the needle plate 9, serving as reflecting surface, is covered by the workpiece W, then the control unit 29 switches the solenoid valves 39 and 40 so via the counter 31 that the cylinder chamber 20 is vented via the hose line 47, the nipple B and the return R of the solenoid valve 39 and pressurized via the hose line 46, whereas compressed air is fed via the hose line 48 to the cylinder chamber 21 vented through the hose line 49, the nipple B and the return R of the solenoid valve 40, thereby pivoting the pressure pad 18 into a position required for the control of the radius R1 located in the part section Z1. This position is shown in FIGS. 1 and 2.

As soon as the workpiece edge in the area of radius R1 leaves the scanning point of the edge scanning device 28 its photodiode is exposed by the light beam now no longer interrupted. This causes the control unit 29 to actuate the solenoid valve 34, switching it into a position in which compressed air is fed to the pneumatic cylinder 16 through the pump nipple P, the working nipple B and the hose line 38 while being vented through the hose line 37, the nipple A and the return R. This causes the pressure pad 18 to be lowered to the workpiece W in the center of rotation of radius R1. Since the feeder 10 of the sewing machine 2 continues to operate, the workpiece W is being rotated about the point where the pressure point 18 has been lowered on the workpiece W as axis of rotation, without moving the workpiece W transverse to the material feeding direction, arrow V, FIG. 3, so that the seam runs exactly parallel to the edge in the area of the outside curve at R1.

When at the end of the radius R1 the light beam is interrupted again by the workpiece W covering the scanning point, the solenoid valve 34 releases, the pneumatic cylinder 16 is vented via the hose line 38, the nipple B and the return of the solenoid 34 and pressurized via the pump nipple P, the working nipple A and the hose line 37 so as to lift the pressure pad 18 off the workpiece W.

As sewing continues, the outside edge of the inside curve B1 of the workpiece W, following the radiud R1 after a short straight stretch of seam, makes contact with the edge ruler 12, and the workpiece W is turned by the material feeder 10 in accordance with the shape of the inside curve B1. When after the end of the partial seam Z1 marked by the reference numeral 51 the scanning point of the edge scanning device 28 is covered up by the workpiece W so as to darken the photodiode of the edge scanning device 28 for the duration of several stitches in the part section Z2 of the seam N, the control unit 29 will activate the solenoid 39 via the counter 31 so as to vent the cylinder chamber 20 of the multiple position cylinder 19 via the line 46, the working nipple A and the return R of the solenoid 39 and pressurize it via the nipples P and B and the line, 47, thereby pivoting the holder 15 with the pneumatic cylinder 16 about the bearing bolt 17 into a position in which the pressure pad 18 is spaced from the needle 4 as required for the control of the next following radius R2.

When the workpiece edge in the area of radius R2 leaves the scanning point of the edge scanning device 28 and its photodiode is exposed again, the control unit 29 activates the solenoid 34 so that compressed air is fed to the pneumatic cylinder 16 via the nipples P and B of the solenoid 34 and the hose line 38. The pneumatic cylinder 16 is then vented through the hose line 37, the nipple A and the return R so that the pressure pad 18 is lowered onto the workpiece W in the center of rotation of radius R2. Due to the continued operation of the material feeder 10 the workpiece W is then rotated about the point where the pressure pad contacts the workpiece W as axis of rotation to form the partial seam parallel to the edge in accordance with the radius R2.

When the light beam is broken again at the end of radius R2 by the workpiece W covering the scanning point of the edge scanning device 28 again, the solenoid valve 34 releases, the pneumatic cylinder 16 is vented via the line 38, the nipple B and the return R and pressurized via the nipples P and A and the line 37. This causes the pressure pad 18 to be lifted off the workpiece W again.

When the scanning point of the edge scanning device 28, after reaching the end 52 of the part section 22 of the seam N is covered up by the workpiece W for the duration of a few stitches in the part section Z3 so that the photodiode of the edge scanning device 28 is darkened, the control unit 29 shuts off the solenoid 39 via the counter 31 and activates the solenoid 40. In this position of the solenoids 39,40 the cylinder chamber 20 of the multiple position cylinder 19 is vented through the line 47, the nipple B and the return R of solenoid 39 and pressurized through the nipples P, A and the line 46, whereas the cylinder chamber 21 is vented through the line 48, the nipple A and the return R of the solenoid 40 and pressurized through the nipples P and B and the line 49. Both piston rods 24 and 26 of the multiple position cylinder 19 are thus extended, the holder 15 with the pneumatic cylinder 16 being pivoted about the bearing bolt 17 into a position in which the pressure pad 18 is spaced from the needle 4 by the distance required for the control of the outside radius R3.

As described in connection with the part sections Z1 and Z2, the last part section Z3 of the seam N with the inside curve B2 and the radius R3 is also controlled, and sewing continues to point 50, where the sewing machine is stopped, the threads are cut and the press foot 11 is raised. The finish-sewn workpiece W can be removed and the sewing machine 2 loaded with a new workpiece to carry out the operations described.

While a specific embodiment of the invention has been shown and described in detail to illustrate the application of the principles of the invention, it will be understood that the invention may be embodied otherwise without departing from such principles.

What is claimed is:

1. A sewing machine, comprising a reciprocating needle, material feeder means for feeding a material workpiece into association with the needle, a guide ruler for guiding the workpiece along the ruler edge in a material guiding device comprising a pressure pad engageable with the workpiece at a distance from said needle, first setting means connected to said pressure pad to raise and lower said pressure pad and second setting means connected to said pressure pad for shifting it toward and away from the needle.

2. A sewing machine according to claim 1, wherein said pressure pad is engageable with the workpiece at a select location from the needle in order to cause the shifting of the workpiece around the needle at a curve determined by the engagement point of the pressure pad and including stitch counter means connected to said sewing machine for counting the stitches which are being made during the turning of the workpiece.

3. A sewing machine according to claim 1, wherein said second setting means for shifting said pressure pad comprises a multiple position cylinder.

4. A sewing machine according to claim 1, wherein said second setting means comprises a stepping motor.

5. A sewing machine according to claim 1, including a pressure pad holder pivotally mounted adjacent said needle for pivotal movement about a substantially horizontal axis, said pressure pad being mounted on said holder and being movable upwardly and downwardly in said holder.

6. In a sewing machine including a sewing plate over which the material to be sewn is fed along a ruler edge between the sewing needle which reciprocates and a shuttle which cooperates with the needle, the improvement comprising a fixed support member, a pressure pad holder pivotally supported on said support member, holder pivot means connected to said holder to pivot said holder so that the lower end thereof moves toward and away from said needle, a pressure pad movably mounted on said holder and being movable relative to said holder to move toward and away from the needle upon the pivoting of said holder for shifting the workpiece engagement point of said pressure pad, pressure pad moving means for moving said pressure pad in said holder toward and away from the material to permit engagement and disengagement therefrom.

7. In a sewing machine according to claim 6, wherein said holder pivot means comprises a fluid piston and cylinder connected to said holder to pivot said holder.

8. In a sewing machine according to claim 6, wherein said pressure pad moving means comprises a fluid pressure cylinder carried by said holder, pressure pad having a piston portion movable in said cylinder.

9. In a sewing machine according to claim 6, including means for scanning the edge of the workpiece, a control connected between said edge scanner and said means for shifting said pressure pad and said control and said means for pivoting said holder.

10. In a sewing machine according to claim 6, including a counter connected to said control for counting the threads of the seam sensed by said scanning device and said pressure pad moving means for controlling said pressure pad in response thereto.

11. A sewing machine according to claim 1 wherein said pressure pad is engagable with the workpiece at a select location from the needle in order to cause the shifting of said workpiece around the needle at a curve determined by the engagement point of the pressure pad, and including stitch counter means connected to said sewing machine for counting the stitches which are being made during the operation of said workpiece in each section and connected to said second setting means for actuating said second setting means to shift said pressure pad selectively toward and away from said needle.

* * * * *